US009398810B2

(12) United States Patent
Donovan et al.

(10) Patent No.: US 9,398,810 B2
(45) Date of Patent: Jul. 26, 2016

(54) RECLINING AND OTTOMAN-EXTENDING CHAIR MECHANISM

(71) Applicant: L & P PROPERTY MANAGEMENT COMPANY, South Gate, CA (US)

(72) Inventors: Bobby Donovan, Mooreville, MS (US); Stephen Simons, Belden, MS (US); Eddie Powell, Tupelo, MS (US)

(73) Assignee: L & P Property Management Company, South Gate, CA (US)

( * ) Notice: Subject to any disclaimer, the term of this patent is extended or adjusted under 35 U.S.C. 154(b) by 205 days.

(21) Appl. No.: 13/972,601

(22) Filed: Aug. 21, 2013

(65) Prior Publication Data

US 2015/0054316 A1 Feb. 26, 2015

(51) Int. Cl.
*A47C 1/034* (2006.01)
*A47C 1/032* (2006.01)

(52) U.S. Cl.
CPC ..... *A47C 1/0342* (2013.01); *A47C 1/032* (2013.01)

(58) Field of Classification Search
CPC .. A47C 1/0345; A47C 1/0355; A47C 1/0342; A47C 1/032
USPC ..... 297/85 R, 85 M
See application file for complete search history.

(56) References Cited

U.S. PATENT DOCUMENTS 3,758,151 A * 9/1973 Re ..... 297/83
4,660,883 A * 4/1987 Kowalski ..... 297/85 R
5,064,244 A * 11/1991 Sproule ..... 297/68
5,312,153 A * 5/1994 Lin ..... 297/89
5,503,453 A * 4/1996 Saul et al. ..... 297/89
5,582,457 A * 12/1996 Komorowski et al. ..... 297/75
5,971,475 A * 10/1999 Lawson et al. ..... 297/85 C
5,975,627 A * 11/1999 LaPointe et al. ..... 297/68
5,992,931 A * 11/1999 LaPointe et al. ..... 297/85 M
6,135,559 A * 10/2000 Kowalski ..... 297/354.12
2001/0035668 A1 11/2001 Gaffney et al.
2010/0212087 A1 8/2010 Leib et al.
2010/0320809 A1 12/2010 Roleder et al.
2011/0175426 A1 7/2011 Lawson
2011/0198894 A1 8/2011 Hsieh et al.
2012/0049606 A1 3/2012 Lawson et al.
2012/0056462 A1 3/2012 Wong
2012/0286557 A1 11/2012 Hoffman et al.
2013/0175847 A1 7/2013 Lawson

OTHER PUBLICATIONS

International Search Report with Written Opinion dated Dec. 18, 2014 in PCT Application No. PCT/US2014/051869, 10 pages.
Non-Final Office Action dated Oct. 8, 2015 in U.S. Appl. No. 14/513,194, 9 pages.
International Preliminary Report on Patentability dated Mar. 3, 2016 in Application No. PCT/US2014/051869, 9 pages.

* cited by examiner

*Primary Examiner* — David R Dunn
*Assistant Examiner* — Tania Abraham
(74) *Attorney, Agent, or Firm* — Shook, Hardy & Bacon L.L.P.

(57) ABSTRACT

A seating-unit mechanism includes various components that control a position of the seat and backrest and that control an extension and retraction of an ottoman and footrest. For example, the mechanism includes a linear actuator that controls a seat pitch (e.g., height and level of recline). In addition, the mechanism includes an ottoman-linkage drive mechanism, which might include a drive link or another linear actuator.

17 Claims, 15 Drawing Sheets

RECLINING AND OTTOMAN-EXTENDING CHAIR MECHANISM

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved mechanism developed to extend an ottoman and footrest and provide reclining functionality.

Reclining seating units exist that allow a user to forwardly extend a footrest or ottoman and to recline a backrest and seat. These existing seating units typically provide three basic positions (e.g., a standard, nonreclined closed position; an extended position; and a reclined position). In the closed position, the seat resides in a generally horizontal orientation and the backrest is disposed substantially upright. Additionally, if the seating unit includes an ottoman attached with a mechanical arrangement, the mechanical arrangement is collapsed such that the ottoman is not extended. In the extended position, the ottoman is extended forward of the seat. In the reclined position the backrest, and possibly the seat, might be tilted rearwardly from the extended or standard position.

BRIEF SUMMARY OF THE INVENTION

At a high level, this invention is directed to a chair mechanism, which reclines a seat and chair back. In addition, if an ottoman and footrest are included on a seating unit, then the mechanism might also extend the ottoman and the footrest. Embodiments of the invention are defined by the claims below, not this summary. A high-level overview of various aspects of the invention are provided here to provide an overview of the disclosure and to introduce a selection of concepts that are further described below in the detailed-description section below. This summary is not intended to identify key features or essential features of the claimed subject matter, nor is it intended to be used as an aid in isolation to determine the scope of the claimed subject matter.

BRIEF DESCRIPTION OF THE SEVERAL VIEWS OF THE DRAWING

The accompanying drawings form a part of the specification, are to be read in conjunction therewith, and are incorporate by reference in their entirety. In the drawings.

DETAILED DESCRIPTION OF THE INVENTION

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Generally, embodiments of this invention introduce technology within the motion furniture industry to improve operation of a seating unit, which includes a reclining seat back and might also include an extendable ottoman and footrest. In a first embodiment (FIGS. 1-3), the chair mechanism includes a single motor that controls the seat and chair back position in a seating unit. In this embodiment, the seating unit might or might not include an ottoman and footrest. In another embodiment (FIGS. 4-6), the chair mechanism includes two motors, one of which controls the seat and chair back position and the other of which extends and retracts the ottoman linkage mechanism. In a further embodiment (FIGS. 8 and 9), the chair mechanism includes a motor that controls the seat and chair back position and a drive link that extends and retracts the ottoman linkage mechanism. Another embodiment of the present invention includes a footrest, which is depicted in FIGS. 10-15.

Figure 1:
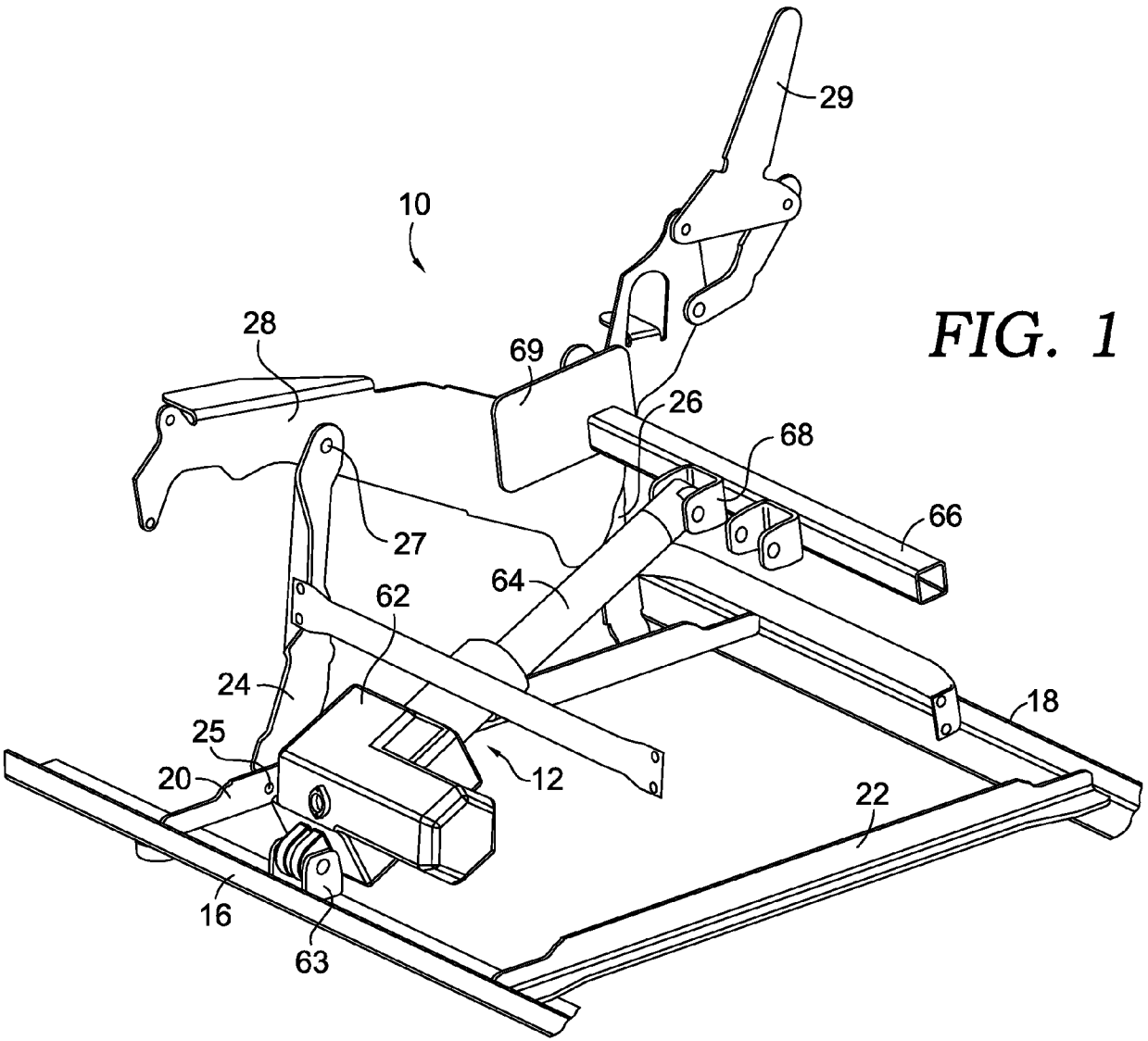
FIG. 1 is a front perspective view of a single-motor chair mechanism in a standard position in accordance with an embodiment of the present invention.
Figure 2:
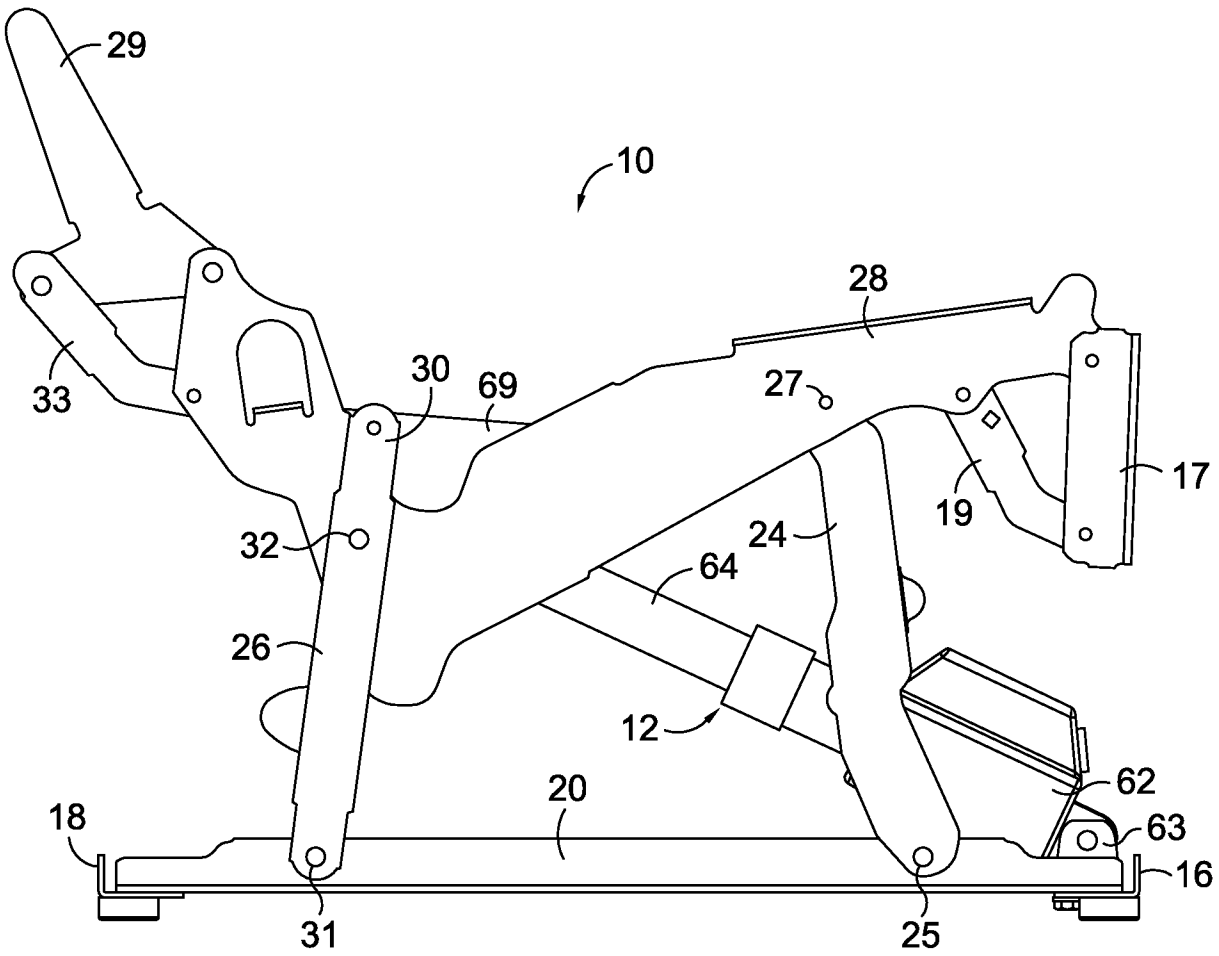
FIG. 2 is a side view of the mechanism depicted in FIG. 1 in accordance with an embodiment of the present invention.
Figure 3:
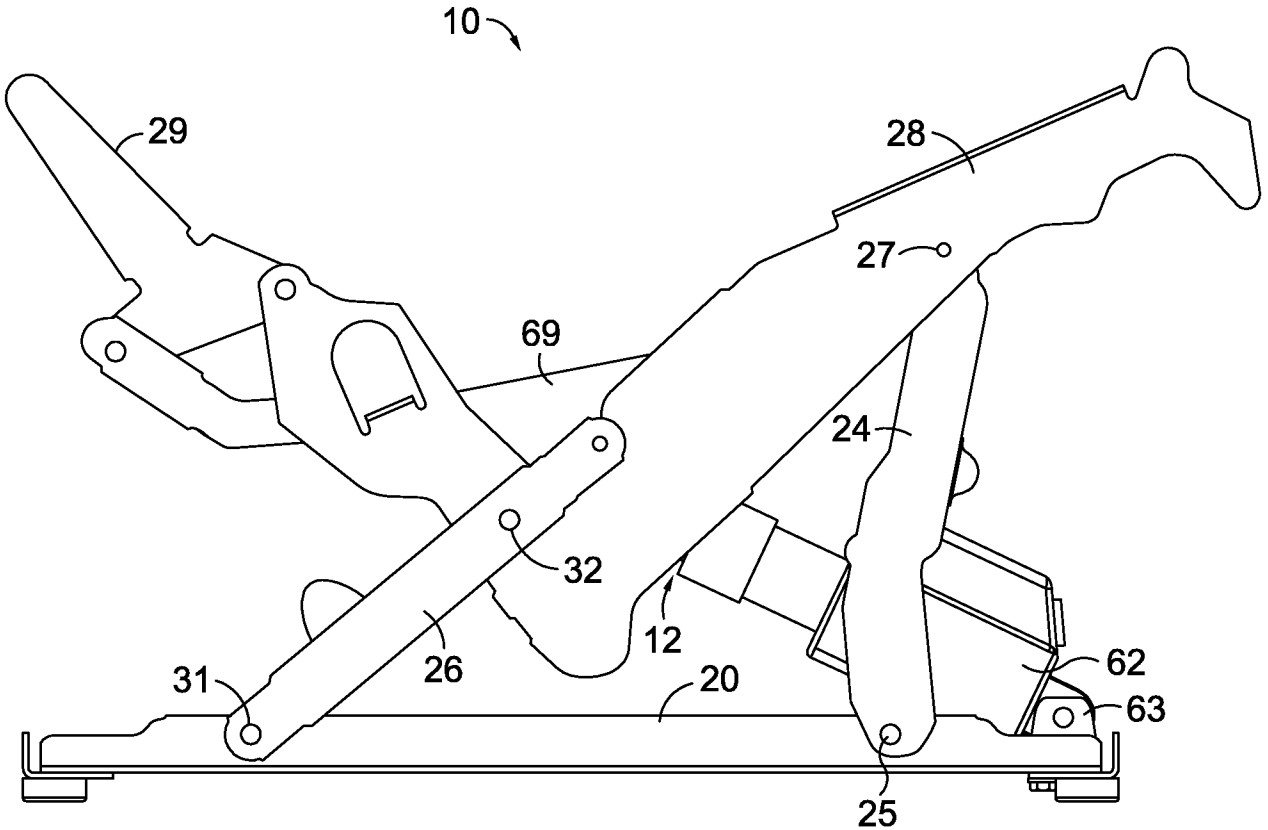
FIG. 3 is another side view of the mechanism depicted in FIG. 1 in which a pitch of the seat plate has been tilted rearward in accordance with an embodiment of the present invention.

Referring now to FIGS. 1-3, an embodiment of the present invention is depicted in which the chair mechanism 10 includes a motor 12, which controls a position of a seat plate 28 and a backrest mounting bracket 29. As such, the motor 12 controls a position of the chair seat and seat back, which are not shown in the figures but would be attached either directly or indirectly to the seat plate 28 and backrest mounting bracket 29. In FIG. 1, the mechanism 10 is depicted from a perspective view, and FIGS. 2 and 3 depict a right-side plan view of the mechanism.

Additional components of the chair mechanism 10 will now be described in greater detail. Throughout this disclosure various components are described, such as linkages, that are pivotably interconnected. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well known in the furniture-manufacturing industry.

Also, the shapes of the linkages and the brackets may vary as desired, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements (such as intervening elements) may also be present.

The chair mechanism 10 includes a front base rail 16, a rear base rail 18, a right base plate 20, and a left base plate 22. Attached to each base plate 20 and 22 are a respective front pivot link and a respective rear pivot link. In the figures, for illustrative purposes, only the right-side pivot links are depicted and are identified as the front pivot link 24 and the rear pivot link 26. It is understood that a mirror set of linkages are coupled to the left base plate 22. That is, in an exemplary configuration, movements of the chair mechanism are controlled by a pair of essentially mirror-image linkage mechanisms (the right linkages being depicted), which comprise an arrangement of pivotably interconnected linkages. The linkage mechanisms are typically disposed in opposing-facing relation about a longitudinally-extending plane that bisects the seating unit between the pair of opposed arms. As such, the ensuing discussion will focus on only one of the linkage mechanisms, with the content being equally applied to the other, complimentary, linkage assembly.

The front pivot link 24 is pivotably attached at pivot 25 to the base plate 20 and is pivotably attached at pivot 27 to a seat plate 28. The rear pivot link 26 is pivotably attached at pivot 31 to the base plate 20 and at pivot 32 to the seat plate 28. In one embodiment the front pivot link 24 and rear pivot link 26 are attached to an outward-facing surface of the base plate 20; the front pivot link 24 is attached to an inward-facing surface of the seat plate 28; and the rear pivot link 26 is attached to an outward-facing surface of the seat plate 28.

The rear pivot link 26 might include a portion 30 (FIG. 2) that extends beyond the pivot 32 at which the rear pivot link 26 attaches to the seat plate 28. However, in embodiments in which an ottoman drive link (e.g., item 80 in FIGS. 8 and 9) is omitted, the portion 30 of the rear drive link might also be omitted. The pivotable attachment of the rear pivot link 26 and the front pivot link 24 to both the base plate 20 and the seat plate 28 allows the seat plate 28 to translate forwardly and downwardly while reclining (FIG. 3), as well as rearwardly and upwardly while returning to a generally horizontal position (FIG. 2).

The seat plate 28 supports a seating structure, such as a seat frame (not shown) and seat cushion (not shown). In addition, the seat plate 28 is coupled to a backrest-mounting bracket 29. The backrest-mounting bracket 29 is attachable to a backrest support structure (not shown), thereby allowing a chair backrest to be connected to the chair seat. The backrest-mounting bracket 29 might be rotatably attached to the seat plate 28, such that the chair backrest can recline relative to the chair seat. Alternatively, the backrest mounting bracket 29 might be attached to the seat plate 28 in a non-rotating manner, such that the angle of the chair backrest is substantially fixed relative to the chair seat. The configuration depicted by the figures in this application includes the backrest mounting bracket 29 that does not rotate respective to the seat plate 28. For example, link 33 is attached to the backrest-mounting bracket 29 and the seat plate 28 and impedes the backrest-mounting bracket 29 from rotating relative to the seat plate 28.

In a further embodiment, the seat plate 28 is also coupled to an ottoman structure. For example, in FIG. 2, the mechanism 10 includes a fixed-ottoman mounting bracket 17, which supports a fixed-ottoman substructure (not shown). The fixed-ottoman mounting bracket 17 is coupled to the seat plate 28 in a non-rotating manner by way of a fixed link 19 that is attached between the fixed-ottoman mounting bracket 17 and the seat plate 28. As such, the fixed-ottoman mounting bracket (as well as an ottoman structure coupled thereto) does not rotate relate to the seat plate 28 and stays in a relatively fixed orientation with respect to the seat plate 28. In other embodiments (e.g., FIGS. 4-6, 8, and 9) an ottoman linkage mechanism 34 is pivotably coupled to the seat plate 28.

Referring to FIGS. 1-3, the chair mechanism 10 includes various elements that control a position of the seat plate 28 and the back mounting bracket 29. For example, the chair mechanism 10 includes a motor 12, which includes a drive unit 62 and a piston 64. The drive unit 62 is pivotably mounted to the front rail 16, such as via a mounting bracket 63. The piston 64 is reciprocatingly coupled with the drive unit 62 at one end, such that the piston 64 is extended and retracted with respect to the drive unit 62. The piston 64 is pivotably coupled at another end to a seat-plate drive tube 66, such as via a mounting bracket 68 The seat-plate drive tube 66 is attached to both the right seat plate 28 and the left seat plate (not shown) and translates the movement of the motor 12 to the seat plate 28. For example, a tube mounting plate 69 attaches the seat-plate drive tube 66 to an inside-facing portion of the seat plate 28. Thus, movement of the seat-plate drive tube 66 is transferred to the seat plate 28 by way of the tube mounting plate 69.

FIGS. 1-3 depict the chair mechanism in various positions, including the standard position (FIGS. 1 and 2) and an extended reclined position (FIG. 3). Thus, the movement of the seat plate 28 from one position to the other by way of the motor 12 is described with reference to FIGS. 1-3. As can be seen in FIG. 2, the seat plate 28 is in a standard, nonreclined position, which includes a seat-plate angle of about 8.12 degrees relative to a horizontal plane. In this standard, nonreclined position, the piston 64 is in an extended position (see also FIG. 1), which biases the seat-plate drive tube 66 rearward. Activation of the drive unit 62 retracts the piston 64 toward the drive unit 62, thereby pulling the seat-plate drive tube 66 downward and forward. This retracted position of the piston 64 is depicted in FIG. 3. Since the seat-plate drive tube 66 is coupled to the seat plate 28 via the tube mounting plate 69, movement of the seat-plate drive tube 66 is translated to the seat plate 28. As such, the seat plate 28, while pivoting on the front pivot link 24 and the rear pivot link 26, also moves downward and forward, thereby creating a seat-plate angle of about 23.62 degrees relative to a horizontal plane. In this embodiment, the change in seat-plate angle is about 15 degrees when moving from the standard seated position to the fully reclined position.

In an embodiment of the present invention, the positions at which the rear pivot link 26 and front pivot link 24 pivotably attach to the side rail 20 and seat plate 28 affects a movement trajectory of the seat plate 28 and the amount of change in seat-plate angle. Generally, the position 32 at which the rear pivot link 26 is pivotably coupled to the seat plate 28 is lower than the position 27 at which the front pivot link 24 is attached to the seat plate 28. As such, the seat plate 28 rotates faster (and to a greater extent) at position 32, thereby causing the seat plate 28 and backrest-mounting bracket 29 to rotate rearward, relative to the position in FIG. 2.

In another embodiment, the distance between the pivot points helps to create a desired amount of seat-plate recline, which is depicted in FIG. 3. In an exemplary embodiment, the distance between pivots 31 and 25 is about 12.5 inches and the distance between pivots 32 and 27 is about 10.004 inches. In addition, this relationship might be defined as a ratio of a distance between pivots 31 and 25 to a distance between pivots 32 and 27, which is about 12.5:10.0. In addition, the distance between pivots 31 and 32 is about 6.564 inches and the distance between pivots 25 to 27 is about 9.534, such that the ratio is about 6.5:9.5. In one embodiment, the chair mechanism 10 might be modified to be larger or smaller consistent with these ratios in order to maintain the change in the seat-plate angle of about 15 degrees.

Movement of seat plate 28 and the backrest-mounting bracket 29 downward, forward, and rotationally rearward, using the motor 12, has been described. Returning the seat plate 28 and the backrest-mounting bracket 29 to a standard, nonreclined position is facilitated by moving the seat-plate drive tube 66 in an opposite direction, which in turn causes a reverse of the above described movements. In one embodiment, moving the seat-plate drive tube 66 in an opposite direction is facilitated by extending the piston 64 away from the drive unit 62 and toward the back of the seating unit.

Figure 4:
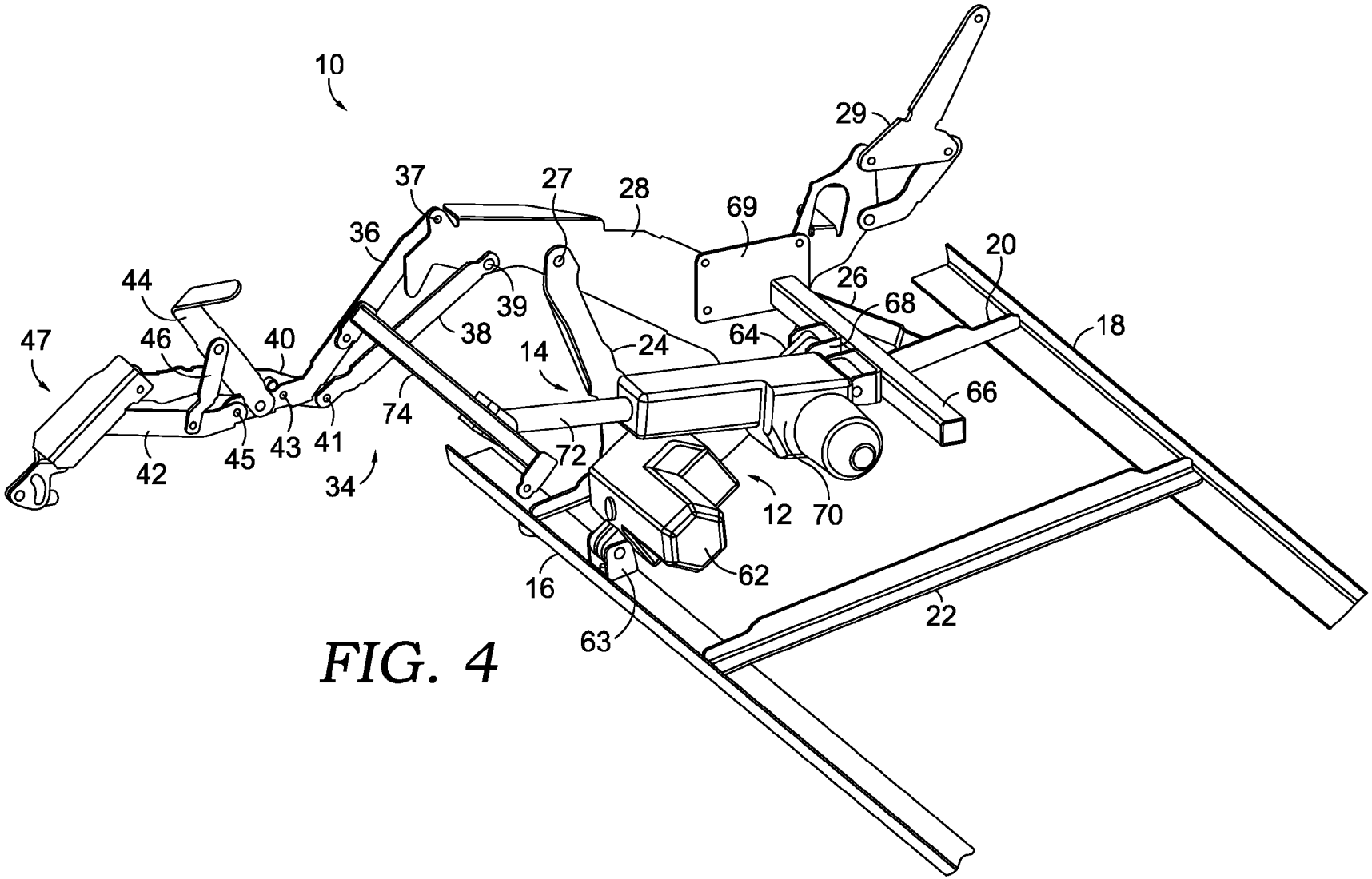
FIG. 4 is a front perspective view of a two-motor chair mechanism in an extended position in accordance with an embodiment of the present invention.
Figure 5:
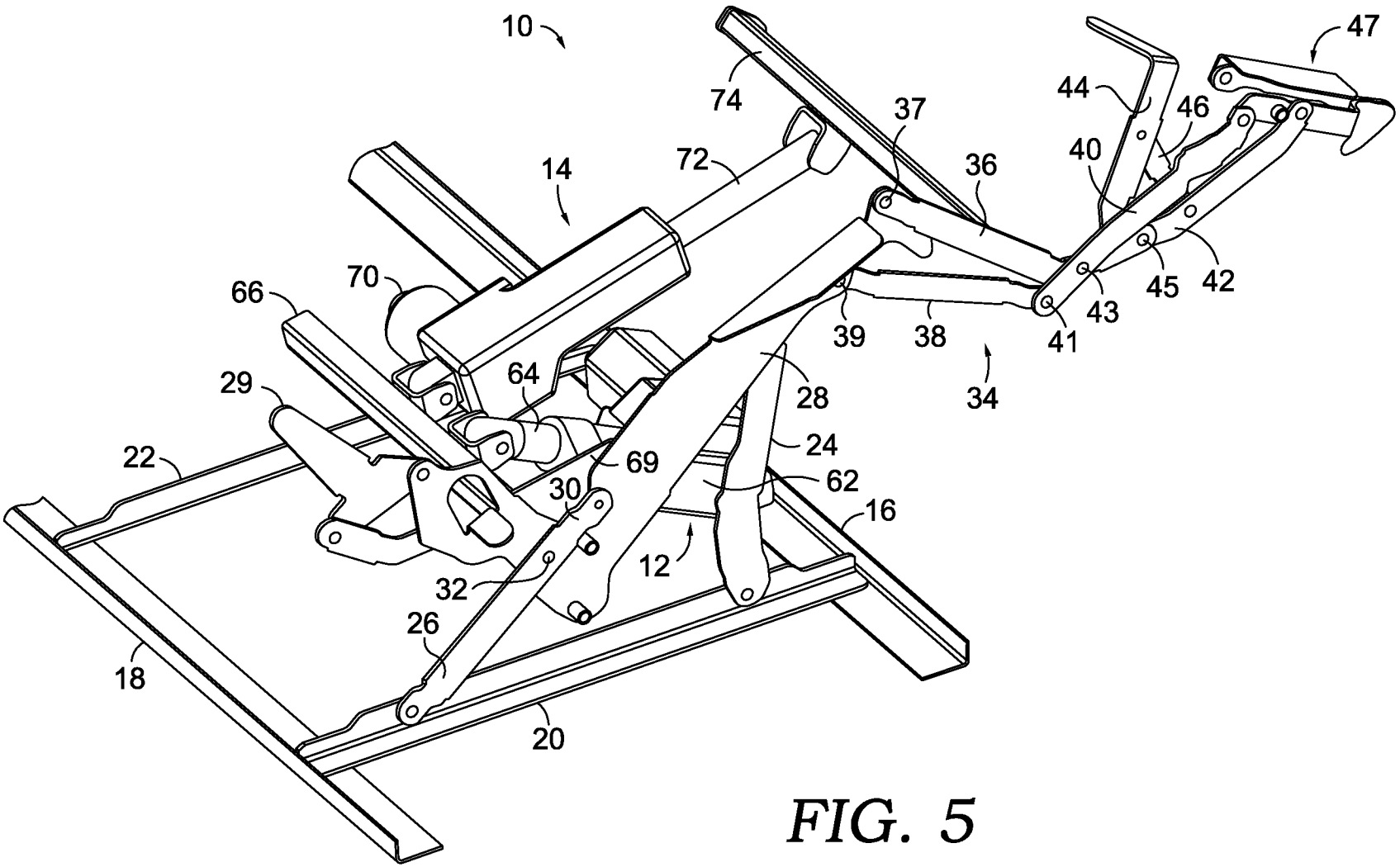
FIG. 5 is a rear perspective view of the mechanism of FIG. 4 in accordance with an embodiment of the present invention.
Figure 6:
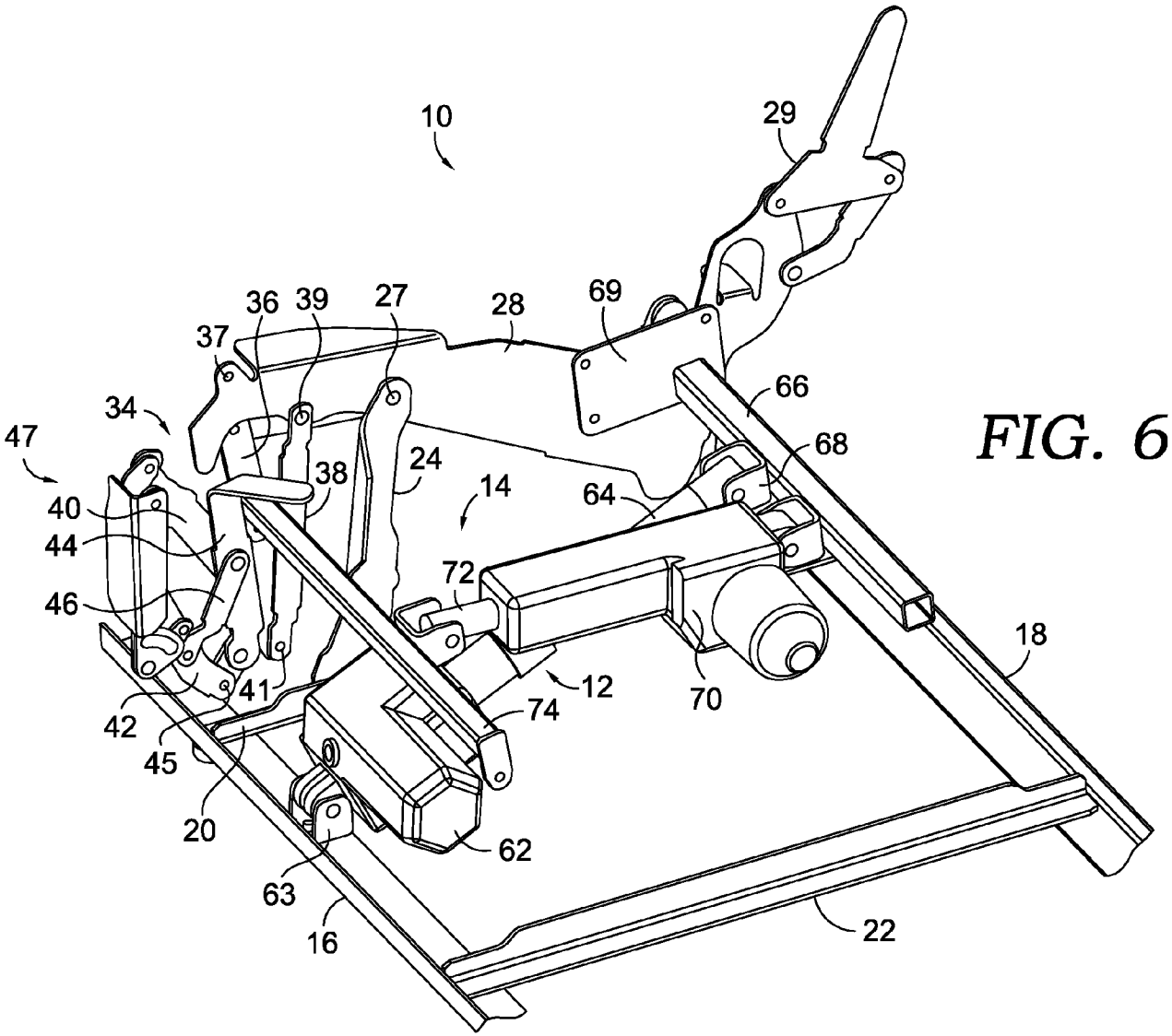
FIG. 6 is a front perspective view of a two-motor chair mechanism in a standard position in accordance with an embodiment of the present invention.
Figure 7:
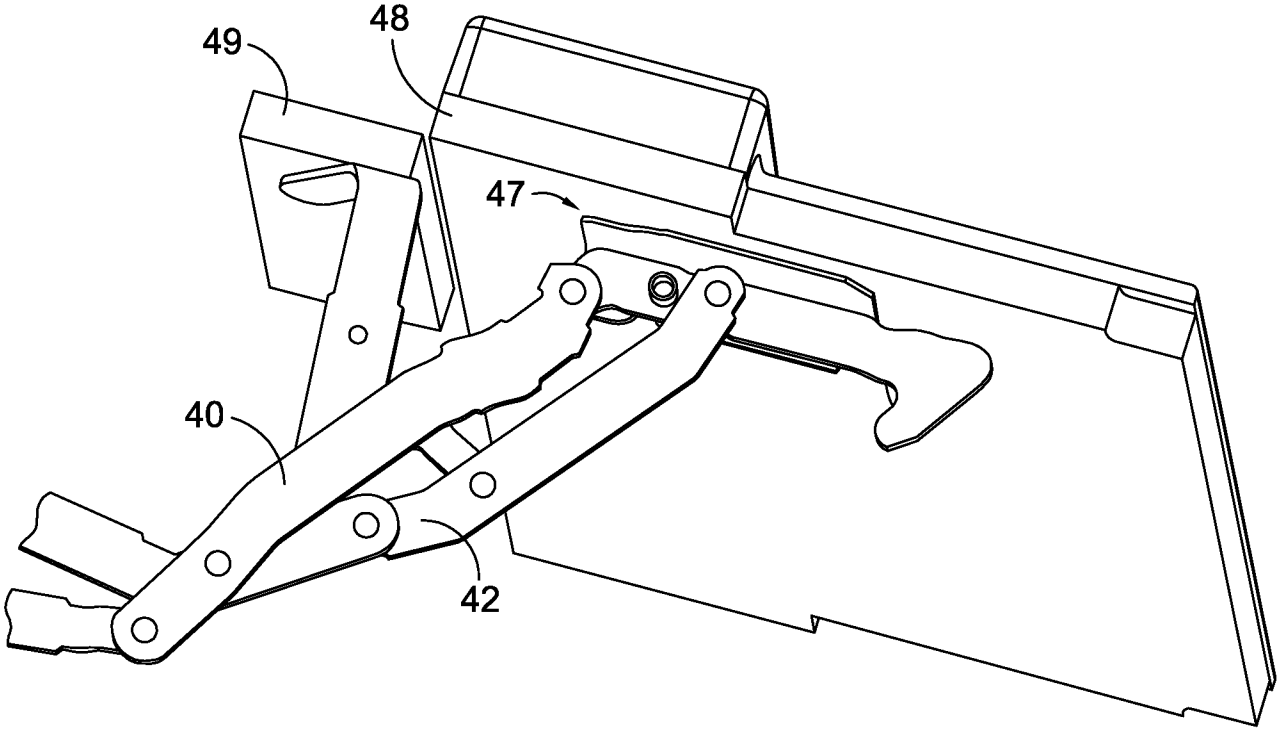
FIG. 7 is lower perspective view of an underneath side of a main ottoman in accordance with an embodiment of the present invention.
Figure 8:
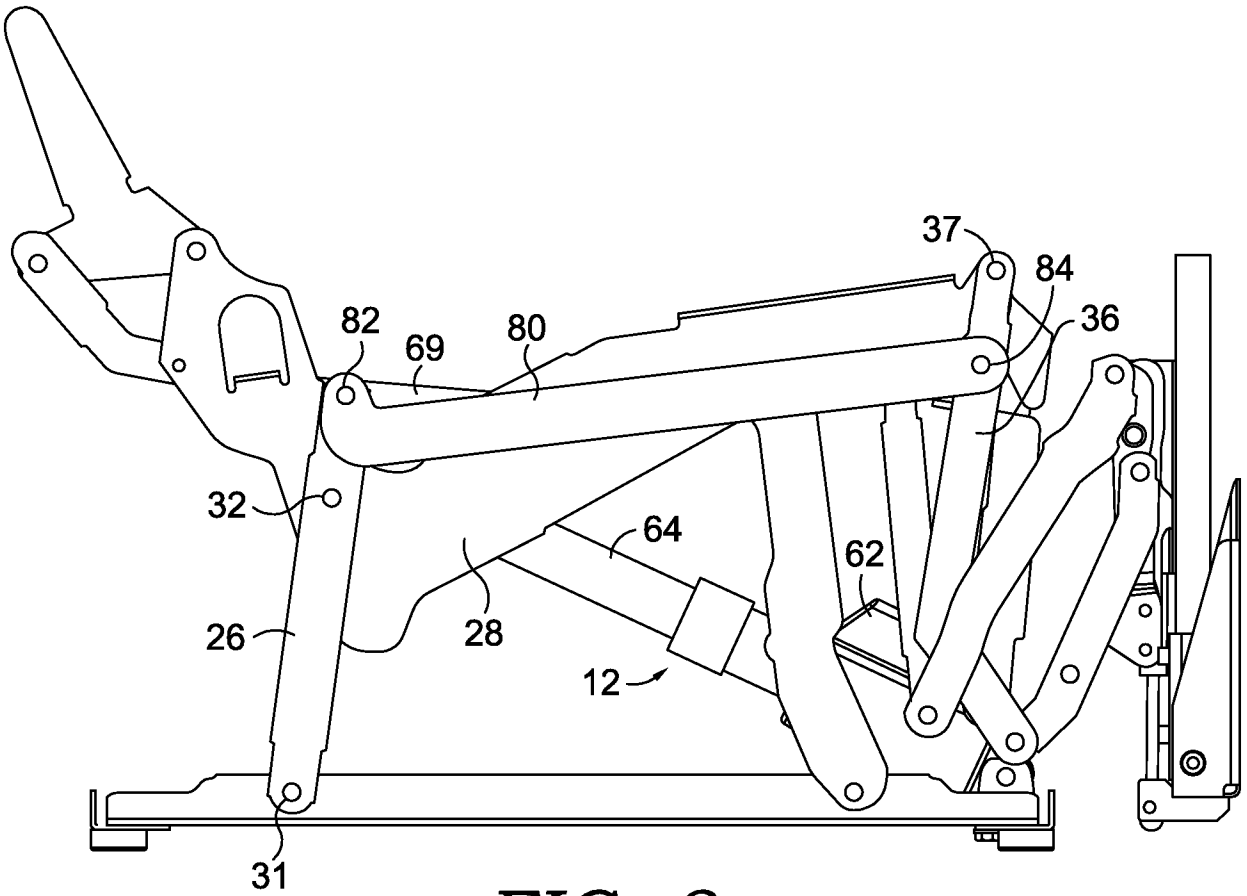
FIG. 8 is a side view of a chair mechanism that includes a motor and an ottoman drive link in a retracted position in accordance with an embodiment of the present invention.
Figure 9:
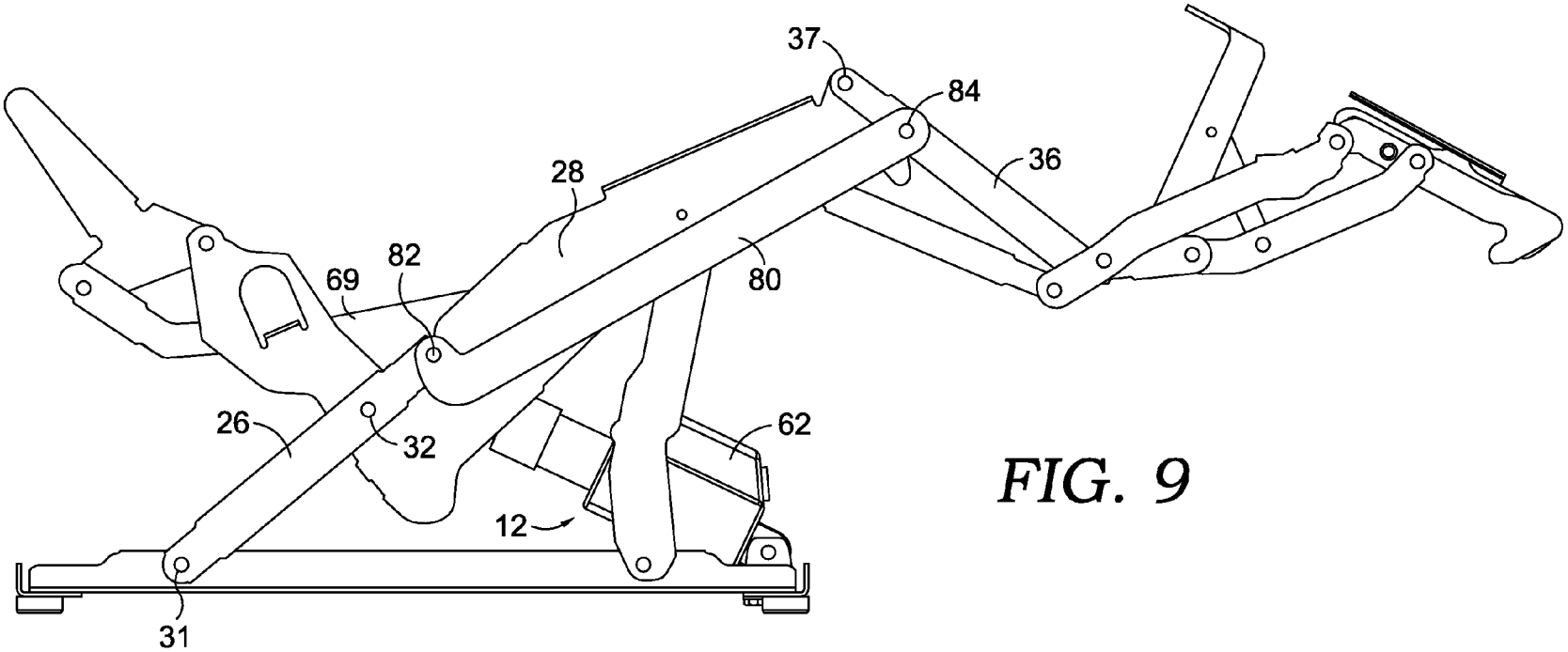
FIG. 9 is another side view of the mechanism of FIG. 8 in an extended position in accordance with an embodiment of the present invention.
Figure 10:
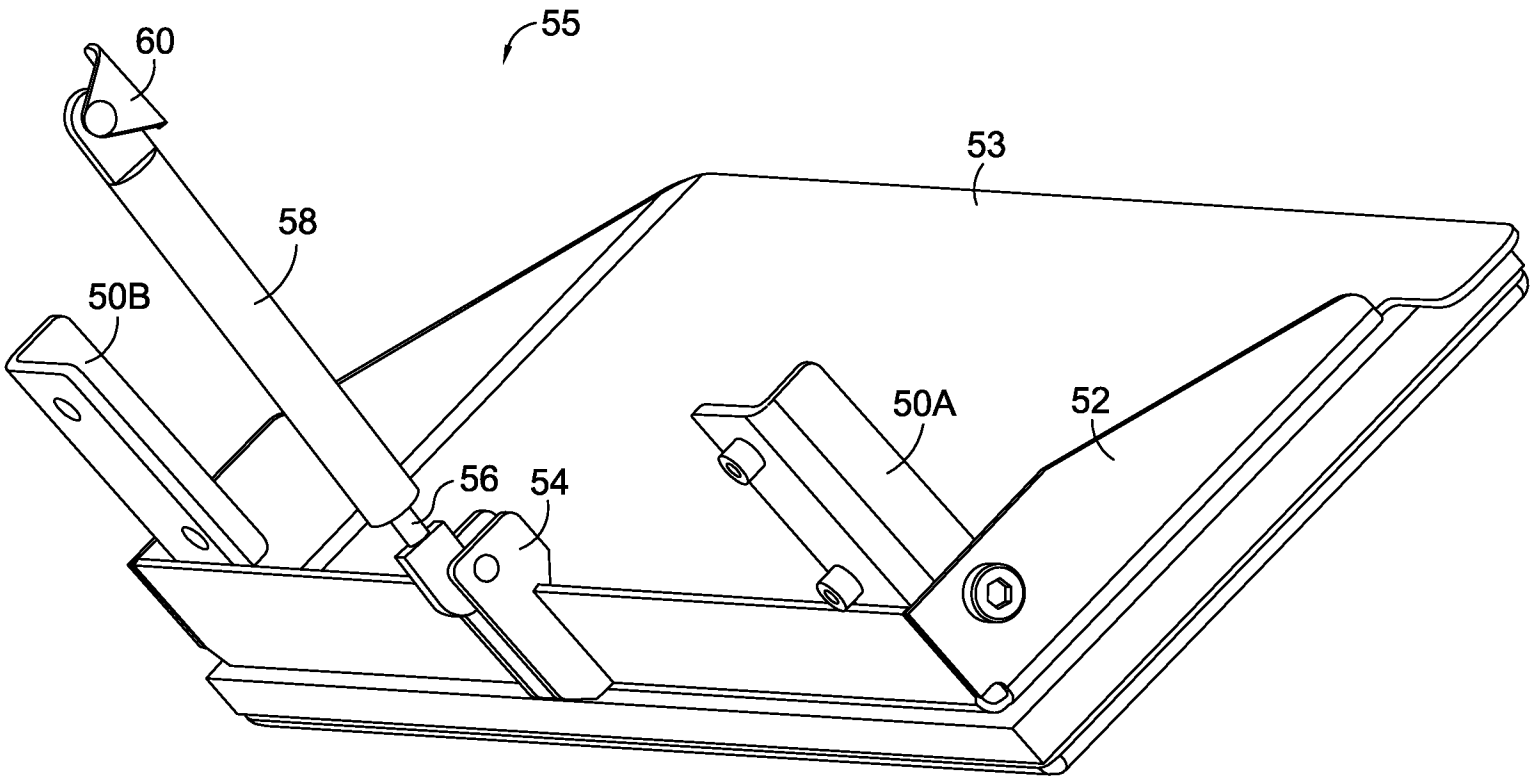
FIG. 10 is a perspective view of a footrest assembly in accordance with an embodiment of the present invention.

FIGS. 1-3 depict one embodiment in which the chair mechanism includes a single motor 12 that facilitates a change in the seat-plate position. In further embodiments (FIGS. 4-9), the chair mechanism 10 also includes a linkage mechanism 34 that functions to extend and retract one or more ottomans. For example, FIGS. 4-6 illustrate one embodiment in which the linkage mechanism 34 is extended and retracted using another motor 14. In addition, FIGS. 8 and 9 illustrate an embodiment in which the linkage mechanism 34 is extended and retracted using an ottoman drive link 80, as opposed to the motor 14.

Referring to FIGS. 4-6 an embodiment of the invention will be described in which the chair mechanism 10 includes a first motor 12 and a second motor 14. A chair mechanism having the first motor 12 and the second motor 14 might also be referred to as a "two-motor chair mechanism." Generally, the first motor 12 controls a position of a chair seat (not shown) and a chair back (not shown), such as in a nonreclined position (e.g., FIGS. 1 and 2) or reclined position (FIG. 3). In addition, the second motor 14 extends and retracts an ottoman (not shown) and footrest (not shown). An extended ottoman position is depicted in FIGS. 4 and 5 and a retracted ottoman position is shown in FIG. 6. While items 12 and 14 are referred to as motors, various linear actuators are suitable and are contemplated as embodiments of the present invention.

In one embodiment depicted by FIGS. 4-6, the chair mechanism 10 includes essentially all of the elements depicted in FIGS. 1-3, which were described above. In a further embodiment, the chair mechanism 10 includes an ottoman linkage mechanism 34, which attaches an ottoman and footrest to the seat plate 28 and which facilitates extension and retraction of the ottoman and footrest. The linkage mechanism 34 is depicted in FIGS. 4-6 unattached to any ottoman structures or footrest structures. However, this omission in FIGS. 4-6 is merely to allow easier viewing of various elements of the linkage mechanism 34. In one embodiment, the linkage mechanism 34 is attached to a mid-ottoman substructure 49 and a main-ottoman substructure 48, as depicted in FIG. 7. In another embodiment, a footrest assembly is also attached to the main-ottoman substructure 48 or the linkage mechanism, as depicted in FIGS. 10-15.

Referring to FIGS. 4-6, the ottoman linkage mechanism 34 includes an ottoman front pivot link 36 and an ottoman rear pivot link 38. Both the ottoman front pivot link 36 and the ottoman rear pivot link 38 are pivotably attached to the seat plate 28. The ottoman front pivot link 36 is pivotably attached to the seat plate 28 at pivot 37, and the ottoman rear pivot link 38 is pivotably attached to the seat plate 28 at pivot 39. In one embodiment, the ottoman front pivot link 36 is attached to an outward-facing surface of the seat plate 28, and the ottoman rear pivot link 38 is attached to an inward-facing surface of the seat plate 28.

The ottoman linkage mechanism 34 also includes an ottoman upper front link 40, which is pivotably attached to the ottoman rear pivot link 38 at pivot 41 and to the ottoman front pivot link 36 at pivot 43. In addition, an ottoman lower front link 42 is pivotably attached to ottoman front pivot link 36 at pivot 45. Also pivotably attached to the ottoman front pivot link 36 is a mid-ottoman mounting bracket 44, which supports a mid-ottoman (not shown). For example, a sub-structure 49 (FIG. 7) of a mid-ottoman might be mounted to the mid-ottoman mounting bracket 44 in order to attach the mid-ottoman to the linkage mechanism 34. A mid-ottoman control link 46 is pivotably attached to both the ottoman lower front link 42 and to the mid-ottoman mounting bracket 44.

In a further embodiment, a main-ottoman mounting bracket 47 is coupled to the ottoman upper front link 40 and the ottoman lower front link 42, and the main-ottoman mounting bracket 47 supports a main ottoman. For example, a main-ottoman substructure 48 (FIG. 7) is mounted to the main-ottoman mounting bracket 47 in order to attach the main ottoman to the linkage mechanism 34. FIG. 7 illustrates an embodiment in which a footrest assembly is not included on the chair mechanism.

The chair mechanism 10 includes various elements that control extension and retraction of the linkage mechanism 34. For example, in the embodiment depicted in FIGS. 4-6, the second motor 14 functions to retract and extend the linkage mechanism 34. The second motor 14 includes a drive unit 70, which functions to extend and retract a piston 72. The drive unit 70 is pivotably attached to the seat-plate drive tube 66 and the piston 72 is coupled to an ottoman-linkage drive tube 74. The ottoman-linkage drive tube 74 is attached to ottoman front pivot link 36 of the right linkage mechanism 34 and is also attached to the ottoman front pivot link of the left linkage mechanism, which is not depicted. As such, translation of the ottoman-linkage drive tube 74 forward and rearward translates a force to the ottoman front pivot link 36 and the other interconnected linkages.

FIGS. 4-6 depict the linkage mechanism 34 in various positions, including the retracted position (FIG. 6) and an extended position (FIGS. 4 and 5). Thus, the movement of the linkage mechanism 34 from one position to the other by way of the second motor 14 is described with reference to FIGS. 4-6. As can be seen in FIG. 6, the linkage mechanism 34 is in a standard, nonextended position. In this standard, nonextended position, the piston 72 is in a retracted position, which biases the ottoman-linkage drive tube 74 rearward, thereby maintaining the ottoman front pivot link 36 in a generally vertical arrangement. Activation of the drive unit 70 extends the piston 72 away from the drive unit 70, thereby causing the ottoman front pivot link 36 to pivot clockwise (FIG. 6 viewing the mechanism from the left side) on pivot 37. The position of the ottoman front pivot link 36 after rotating clockwise is depicted in FIG. 4.

Clockwise rotation of the ottoman front pivot link 36 sets a series of other linkages into motion. For example, clockwise rotation of the ottoman front pivot link 36 forces the ottoman upper front link 40 to extend outward and causes the ottoman upper front link 40 to rotate counterclockwise on pivot 43. Extension of the ottoman upper front link 40 outward pulls the ottoman rear pivot link 38 outward, thereby causing the ottoman rear pivot link 38 to rotate clockwise on pivot 39. Clockwise rotation of the ottoman front pivot link 36 also causes the ottoman lower front link 42 to extend and rotate counterclockwise on pivot 45. Thus, both the ottoman upper front link 40 and ottoman lower front link 42 are extended outward when the ottoman front pivot link 36 is extended. The geometries of these links 40 and 42 causes the main-ottoman mounting bracket 47 to rotate clockwise to an angle configured to support a user's legs.

In a further aspect, the motion of the mid-ottoman mounting bracket 44 is determined by the ottoman front pivot link 36 and the mid-ottoman control link 46, which is attached to the ottoman lower front link 42. That is, as the ottoman front pivot link 36 and the ottoman lower front link 42 are extended, the mid-ottoman control link 46 restricts clockwise rotation of the mid-ottoman mounting bracket 44, thereby aligning the mounting plate of the mid-ottoman mounting bracket 44 with the main-ottoman mounting bracket 47.

Movement of the linkage mechanism 34 (and the various linkages associate therewith) from a retracted position to an extended position, using the motor 14, has been described. Collapsing, closing, and retracting these elements is facilitated by moving the ottoman-linkage drive tube 74 in an opposite direction, which in turn causes a reverse of the above described movements. In one embodiment, moving the ottoman-linkage drive tube 74 in an opposite direction is facilitated by retracting the piston 72 toward the drive unit 74.

FIGS. 4-6 depict a two-motor chair mechanism. When the chair mechanism 10 includes two different motors (12 and 14), the position of the seat plate 28 and backrest can be controlled (via motor 12) independently of the extension or retraction of the ottoman and footrest (via motor 14). Thus in one motion the chair mechanism can change the seat pitch by an angle of about 15 degrees and in a different motion the chair mechanism can extend and retract the ottoman.

In an alternative embodiment, the chair mechanism includes the motor 12, but the motor 14 is replaced by a different drive mechanism, which controls the extension and retraction of the linkage mechanism 34. Referring to FIGS. 8 and 9 an ottoman drive link 80 is depicted. The ottoman drive link 80 is pivotably connected at pivot 82 to the rear pivot link 26 and is pivotably connected at pivot 84 to the ottoman front pivot link 36.

In FIG. 8 the ottoman drive link 80 is depicted in a rearward biased position, which is achieved when the piston 64 is extended towards the back of the chair mechanism. That is, when the piston 64 pushes the drive tube 66 (FIG. 1) rearward, the rearward bias is translated via the mounting plate 69 to the seat plate 28. Rearward bias of the seat plate 28 is translated to the rear pivot link 26 by way of the pivot 32. As described above, when the piston 64 is retracted toward the drive unit 62, the seat plate 28 rotates rearward and moves forward and downward, thereby causing the rear pivot link 26 to pivot clockwise on pivot 31 (as viewed from the right side in FIGS. 8 and 9). Rotation of the rear pivot link 26 clockwise forces the ottoman drive link 80 forward as depicted in FIG. 9. That is, forward rotation of the rear pivot link 26 is transferred to the ottoman drive link 80 by way of pivot 82. When the ottoman drive link 80 moves forward, the connection at pivot 84 drives the ottoman front pivot link 36 forward, such that the ottoman front pivot link 36 rotates counterclockwise on pivot 37 (based on the right-side view depicted in FIGS. 8 and 9). Rotation of the ottoman front pivot link 36 in this manner extends the ottoman linkages as previously described with respect to FIGS. 4-6.

Movement of the ottoman drive link 80 and the resultant rotation of the ottoman front pivot link 36 from a retracted position to an extended position has been described. Collapsing, closing, and retracting these elements is facilitated by moving the ottoman drive link 80 rearward in an opposite direction, which in turn causes a reverse of the above described movements. In one embodiment, moving the ottoman drive link 80 rearward is facilitated by extending the piston 64 away from the drive unit 62, which causes the seat plate 28 to return to the standard, nonreclined position. When the chair mechanism 10 includes the motor 12 and the ottoman drive link 80, the position of the seat plate 28, the backrest, and the ottoman linkages are all controlled at the same time using the motor 12. As such, in one motion the chair mechanism functions to extend the ottoman and recline the seat-plate angle by about 15 degrees.

Figure 11:
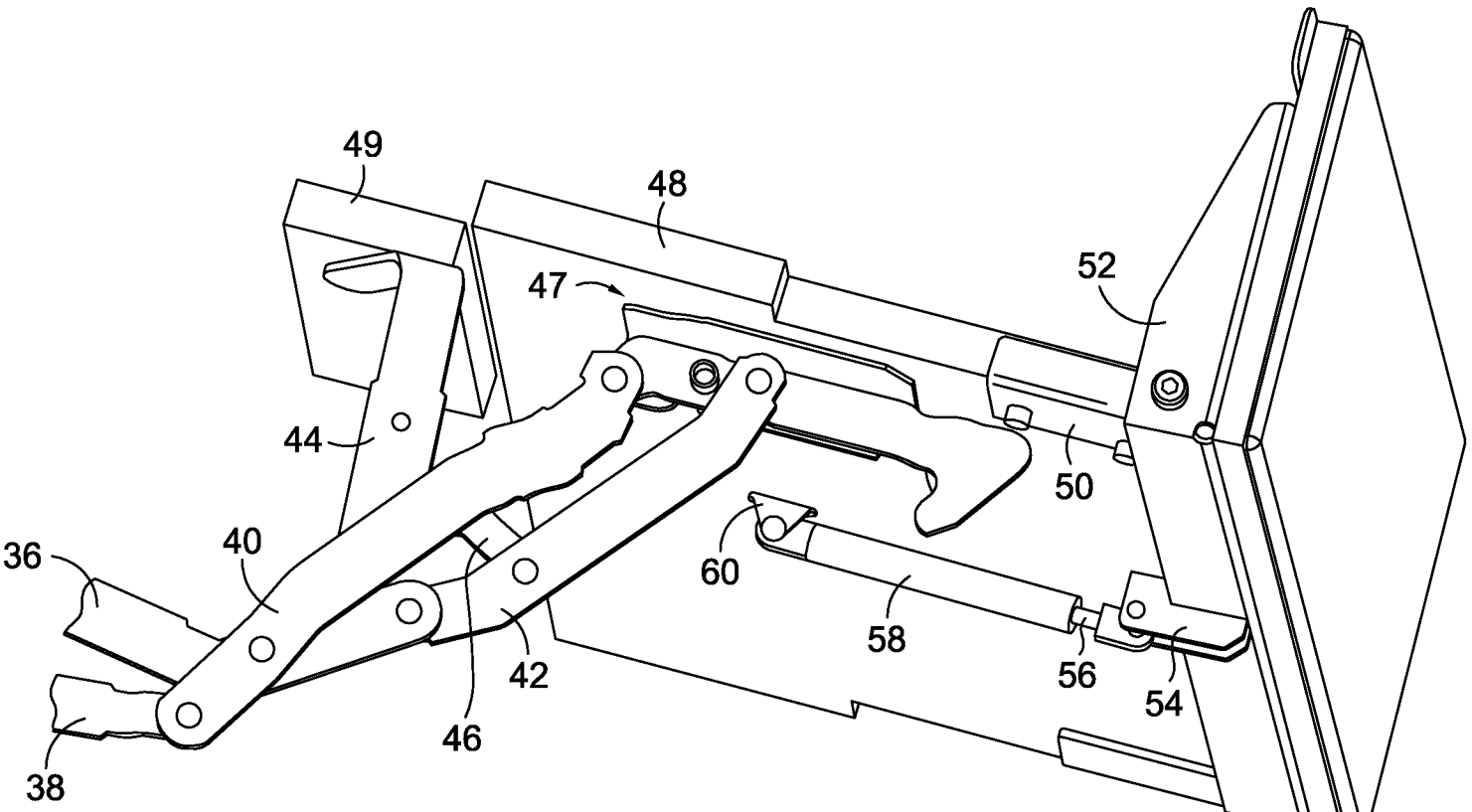
FIGS. 11 and 12 depict the footrest assembly of FIG. 10 coupled to a main-ottoman substructure and open in accordance with an embodiment of the present invention.
Figure 12:
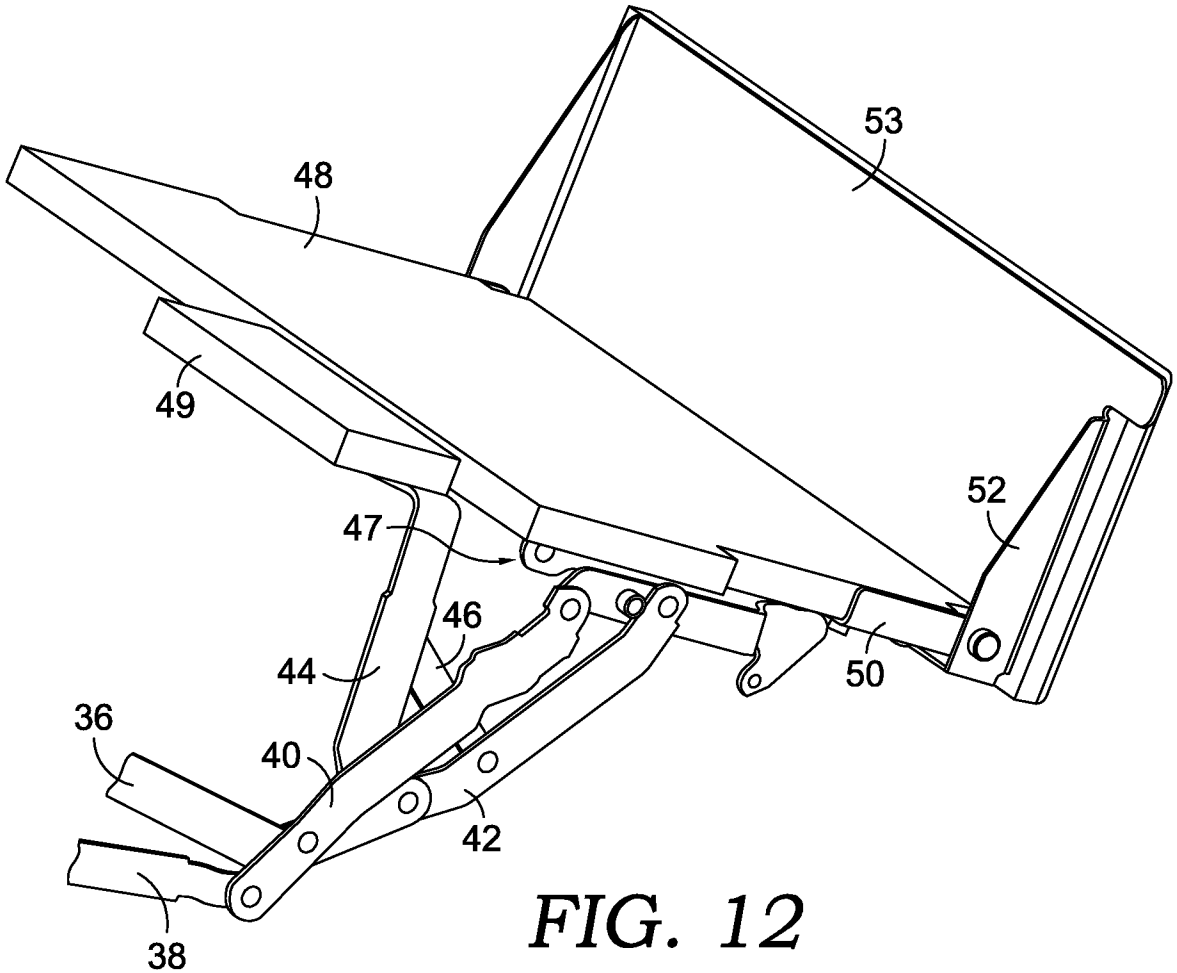
Figure 13:
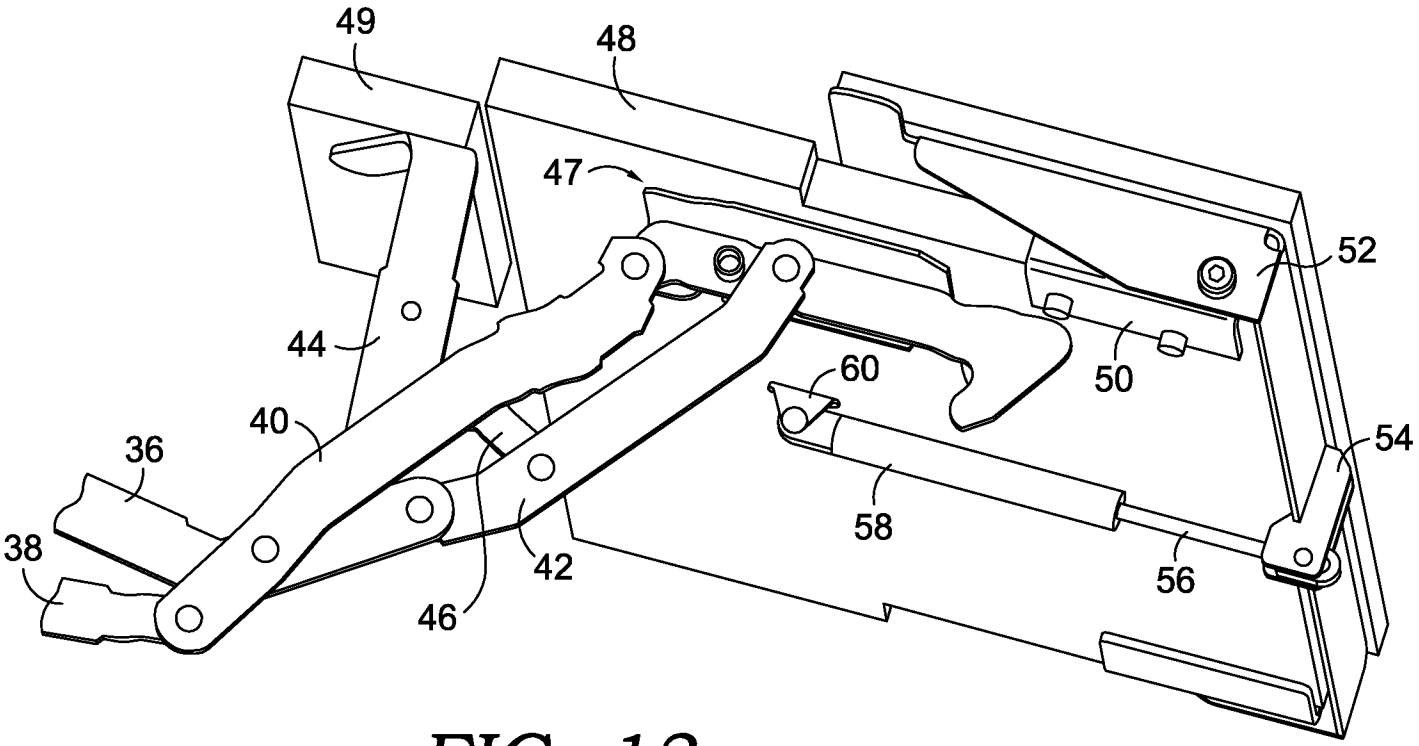
FIG. 13 depicts the footrest assembly of FIG. 10 coupled to a main-ottoman substructure and stowed in accordance with an embodiment of the present invention.

In another embodiment, a footrest assembly 55 (FIG. 10-15) is an add-on to the linkage mechanism 34. That is, the footrest assembly 55 can be added to the linkage mechanism 34 or removed from the linkage mechanism without affecting the overall functionality and operation of the other components of the linkage mechanism. The footrest assembly 55 includes a hinge plate 50A and 50B, which pivotably attaches to a footrest plate 52 and is attachable to an underneath side of the main-ottoman substructure 48 (FIGS. 11 and 13). The footrest plate 52 includes a right side that attaches to the hinge plate 50A on the right side of the chair mechanism and a left side that attaches to the hinge plate 50B on the left side of the chair mechanism. In one embodiment, the footrest plate 52 includes a middle region 53 that extends between the right and left sides and that provides a rigid backing for a footrest. In other embodiments, right and left sides are adjoined by a footrest substructure onto which a cushion is attached. The footrest plate 52 includes a gas-spring mounting plate 54, which pivotably attaches to an end of a gas spring shaft 56. The gas spring shaft 56 is slidably coupled with a gas spring housing 58, which controls a rate at which the gas spring shaft 56 axially slides. The gas spring housing 58 attaches to another mounting bracket 60, which is also attachable on the underneath side of the main-ottoman substructure 48 (FIGS. 11 and 13).

The gas spring functions to bias the footrest plate 52 in a closed position, as depicted in FIG. 13. That is, the footrest plate 52 is biased in a storage position, which is folded against the main ottoman. The footrest plate 52 can be pivoted about 90 degrees to an open position (FIGS. 11 and 12), which provides support to a user's feet. For example, a user might use his or her foot (e.g., heel) to pivot the footrest plate 52 to the open position. When the force applied by a user to the footrest plate 52 exceeds the biasing force provided by the gas spring, the gas-spring shaft 56 slides into the gas spring housing 58. When the user-applied force is removed from the footrest plate 52, the biasing force provided by the gas spring extends the gas spring shaft 56, thereby causing the footrest plate 52 to pivot to the closed position by way of the pivoting attachment to the hinge plate 50. While a gas spring is described herein and is depicted in the figures, the gas spring could include or be replaced by any suitable linear actuator.

Figure 14:
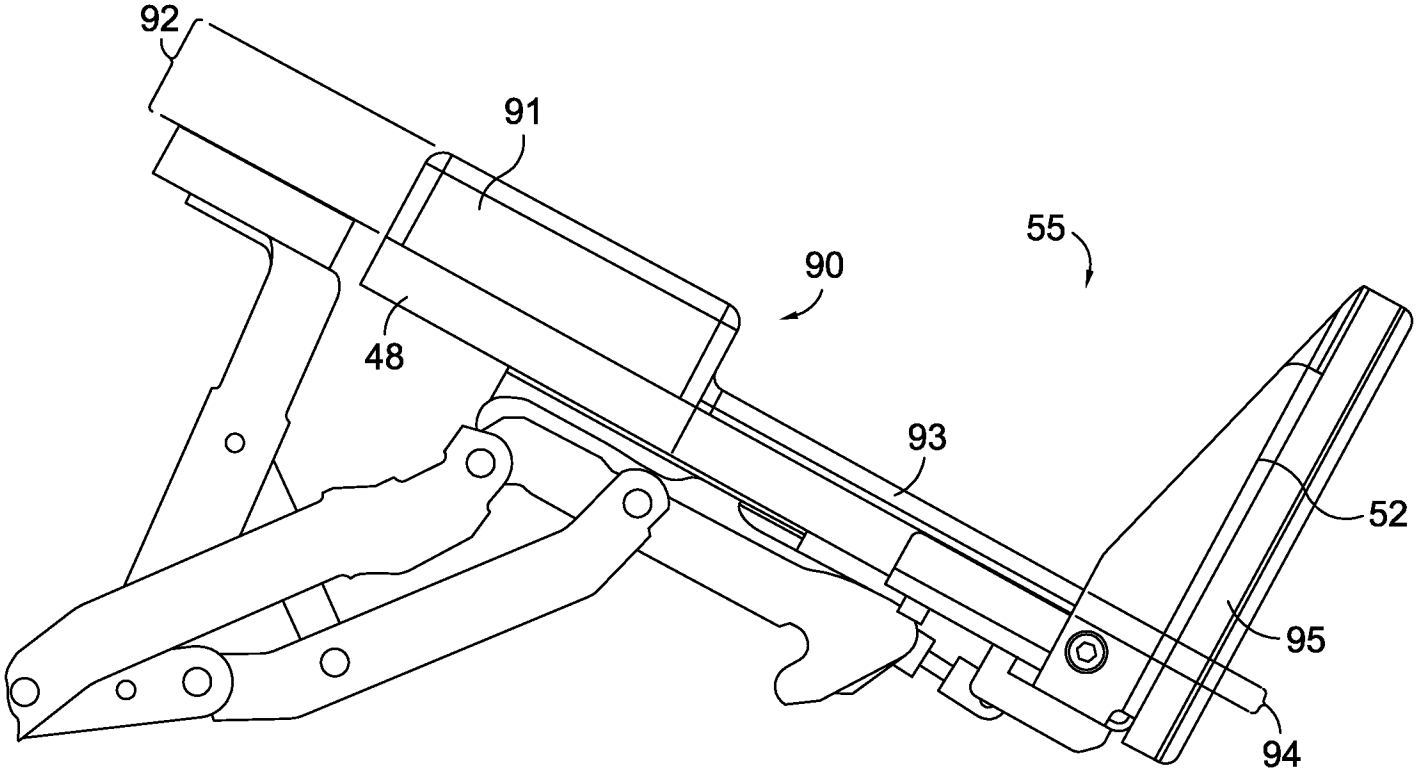
FIGS. 14 and 15 depict side views of the footrest assembly in an open and stowed position in accordance with an embodiment of the present invention.
Figure 15:
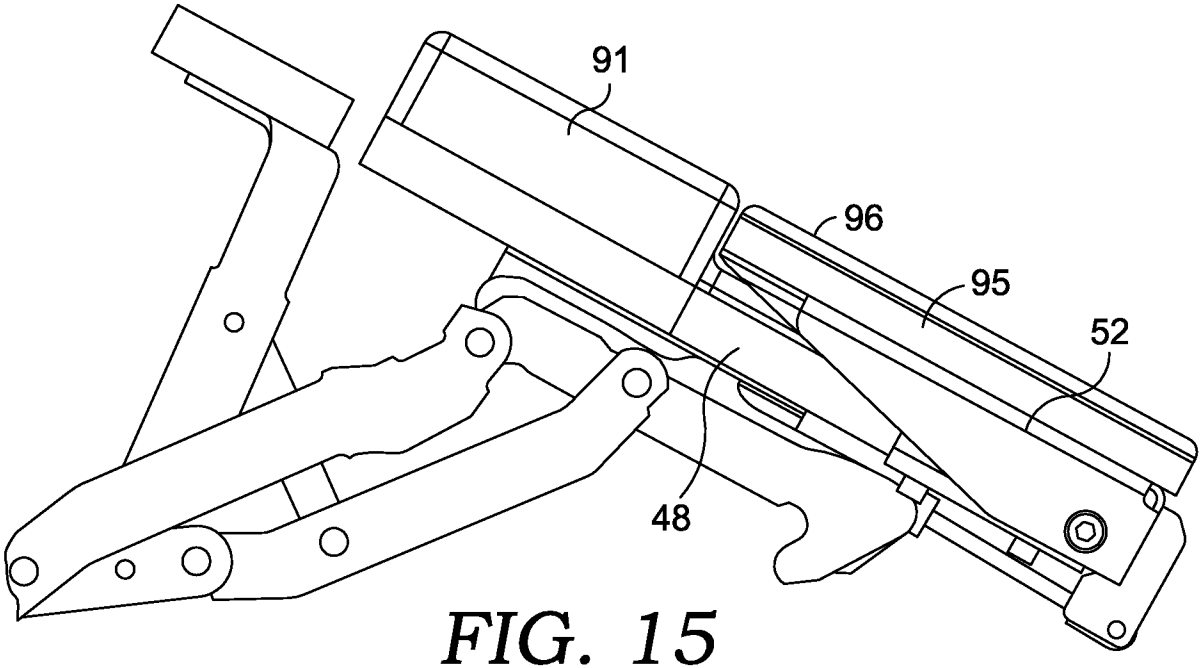

In FIGS. 14 and 15, another aspect of the footrest assembly 55 is depicted. A main-ottoman cushion 90 is coupled to the main-ottoman substructure 48. The main-ottoman cushion 90 includes a first portion 91, which includes a first depth 92, and a second portion 93 having a second depth 94, which is smaller than the first depth 92. As such, the depth of the second portion 93 creates a recessed region, which is occupied by the footrest plate 52 when the footrest plate is biased in the closed position. The footrest plate 52 also includes a cushion 95. As depicted in FIG. 15, when the footrest plate 52 is biased in a closed position and occupies the recessed region, the cushion 95 of the footrest plate 52 is positioned adjacent to the first portion 91 of the main-ottoman cushion. When the footrest plate 52 is in a closed position, a top support surface 96 of the cushion 95 is a distance away from the main-ottoman substructure 48, and the distance is substantially similar to the depth 92. Thus, when the footrest plate 52 is in the closed position, the main ottoman includes a substantially flat support surface comprised of the first portion 91 and the cushion 95. This substantially flat support surface might be utilized when the ottoman linkage mechanism 34 is either extended or retracted.

Thus, a mechanism has been described for adjusting one or more positions of a seating unit. As depicted in FIGS. 1-3, the mechanism includes a motor 12, which functions to change a pitch of the seat plate. In particular, the mechanism might change the pitch of the seat plate by at least about 15 degrees while the backrest-mounting bracket remains at a substantially fixed angle relative to the seat plate. In an embodiment of the present invention, the geometries of the side rail, front pivot link, rear pivot link, and seat plate enable the seat pitch to be changed by the at least about 15 degrees. As such, the seating unit is well suited for use in various contexts in which a change in seat-plate pitch is desired while maintaining a relatively constant backrest angle relative to the seat plate. One such context includes a theater in which the screen or stage is elevated relative to the patron. Although a backrest is described herein that is fixed relative to the seat, in other embodiments, the backrest might also pivot rearwardly to provide additional recline.

Using the seating mechanism described herein, the seat pitch can be modified to allow for more comfortable viewing. In a further embodiment, the mechanism might include an ottoman linkage, which is extendable and retractable using a second motor or a drive link. When the ottoman linkage is controlled using a second motor, the ottoman linkage and the seat plate are adjustable independent of one another. Alternatively, when the ottoman linkage is controlled using the drive link, the ottoman linkage and the seat plate are adjusted simultaneously based on the motor 12. In a further embodiment, a footrest assembly is attached to the ottoman to provide a flip-down footrest.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described herein above. Rather, all matter herein set forth or shown in the accompanying drawings is to be interpreted as illustrative and not limiting.

What is claimed is:

1. A mechanism for adjusting seating positions of a seating unit, the mechanism comprising:

a pair of side rails;

a pair of mirror-image linkage mechanisms, each of which is attached to respective side rail and each of which comprises:

a front pivot link and a rear pivot link pivotably coupled to the respective side rail, a seat plate pivotably coupled to the front pivot link and the rear pivot link, an ottoman front pivot link and an ottoman rear pivot link pivotably coupled to the seat plate, an ottoman upper front link pivotably attached to the ottoman front pivot link and to the ottoman rear pivot link, an ottoman lower front link pivotably coupled to the ottoman front pivot link, a main-ottoman mounting bracket pivotably coupled to both the ottoman upper front link and the ottoman lower front link, the main-ottoman mounting bracket supporting a main-ottoman substructure, which extends between both main-ottoman mounting brackets of the mirror-image linkage mechanism;

a seat-plate drive tube extending between and coupled to both seat plates of the mirror-image linkage mechanisms;

a linear actuator coupled to the seat-plate drive tube that controls a position of the seat plates; and one or more ottoman-linkage drive mechanisms operatively coupled to the ottoman front pivot links of the mirror-image linkage mechanism, the one or more ottoman-linkage drive mechanisms comprising an ottoman drive link pivotably coupled to the rear pivot link and to the ottoman front pivot link for controlling extension and retraction of an ottoman.

2. The mechanism of claim 1, wherein activation of the linear actuator coupled to the seat plate causes the rear pivot link to pivot on the respective side rail and wherein pivoting of the rear pivot link on the respective side rail causes the ottoman drive link to impart a force on the ottoman front pivot link.

3. The mechanism of claim 1 further comprising, a footrest plate hingedly coupled to the main-ottoman substructure, wherein the footrest plate is pivotable from a closed position in which the footrest plate is folded against a main ottoman cushion to an open position in which the footrest plate is rotated to about 90 degrees with the main ottoman cushion.

4. A mechanism for adjusting seating positions of a seating unit, the mechanism comprising:

a pair of side rails;

a pair of mirror-image linkage mechanisms, each of which is attached to a respective side rail and each of which comprises:

a front pivot link pivotably coupled directly to the respective side rail at a first pivot point and pivotably coupled directly to a seat plate at a second pivot point, the first pivot point spaced apart from the second pivot point by a first distance; and a rear pivot link pivotably coupled directly to the respective side rail at a third pivot point and pivotably coupled directly to the seat plate at a fourth pivot point, the third pivot point spaced apart from the fourth pivot point by a second distance, wherein a ratio of the first distance to the second distance is about 9.5:6.5, and the seat plate pivotably coupled directly to the front pivot link and directly to the rear pivot link, a seat-plate drive tube extending between and coupled to both seat plates of the mirror-image linkage mechanisms; and a linear actuator coupled to the seat-plate drive tube that moves the seat plates between a first position and a second position by pivoting the seat plates on the front pivot links and the rear pivot links, wherein a pitch of the seat plates changes by about 15 degrees relative to the respective side rails when the seat plates move between the first position and the second position.

5. The mechanism of claim 4, wherein the first pivot and the third pivot are spaced a third distance apart;

wherein the second pivot and the fourth pivot are spaced a fourth distance apart; and wherein a ratio of the third distance to the fourth distance is about 10:12.5.

6. The mechanism of claim 4 further comprising a backrest-mounting bracket that is non-rotatably coupled to the seat plate.

7. The mechanism of claim 4, wherein each linkage mechanism comprises:

an ottoman front pivot link and an ottoman rear pivot link pivotably coupled to the seat plate, an ottoman upper front link pivotably attached to the ottoman front pivot link and to the ottoman rear pivot link, an ottoman lower front link pivotably coupled to the ottoman front pivot link, and a main-ottoman mounting bracket pivotably coupled to both the ottoman upper front link and the ottoman lower front link, the main-ottoman mounting bracket supporting a main-ottoman substructure, which extends between both main-ottoman mounting brackets of the mirror-image linkage mechanism.

8. The mechanism of claim 7 further comprising, one or more ottoman-linkage drive mechanisms operatively coupled to the ottoman front pivot links of the mirror-image linkage mechanism, the one or more ottoman-linkage drive mechanisms controlling extension and retraction of an ottoman.

9. The mechanism of claim 8, wherein the one or more ottoman-linkage drive mechanisms comprises:

an ottoman-linkage drive tube extending between and coupled to both ottoman front pivot links of the mirror-image linkage mechanisms, and a linear actuator coupled to the ottoman-linkage drive tube.

10. The mechanism of claim 9, wherein the linear actuator coupled to the ottoman linkage drive tube is controllable independently from the linear actuator coupled to the seat-plate drive tube.

11. The mechanism of claim 8, wherein the one or more ottoman-linkage drive mechanisms comprises an ottoman drive link pivotably coupled to the rear pivot link and the ottoman front pivot link.

12. The mechanism of claim 11, wherein activation of the linear actuator coupled to the seat plate causes the rear pivot link to pivot on the respective side rail and wherein pivoting of the rear pivot link on the respective side rail causes the ottoman drive link to impart a force on the ottoman front pivot link.

13. The mechanism of claim 7 further comprising, a footrest plate hingedly coupled to the main-ottoman substructure, wherein the footrest plate is coupled to a gas spring that applies a biasing force to the footrest plate to hold the footrest in a closed position and wherein the footrest plate is pivotable from the closed position to an open position when a force is imparted on the footrest plate to overcome the biasing force.

14. A mechanism for adjusting seating positions of a seating unit, the mechanism comprising:

a pair of side rails;

a pair of mirror-image linkage mechanisms, each of which is attached to respective side rail and each of which comprises:

a front pivot link and a rear pivot link pivotably coupled to the respective side rail, a seat plate pivotably coupled to the front pivot link and the rear pivot link, an ottoman front pivot link and an ottoman rear pivot link pivotably coupled to the seat plate, an ottoman upper front link pivotably attached to the ottoman front pivot link and to the ottoman rear pivot link, an ottoman lower front link pivotably coupled to the ottoman front pivot link, a main-ottoman mounting bracket pivotably coupled to both the ottoman upper front link and the ottoman lower front link, the main-ottoman mounting bracket supporting a main-ottoman substructure, which extends between both main-ottoman mounting brackets of the mirror-image linkage mechanism;

a seat-plate drive tube extending between and coupled to both seat plates of the mirror-image linkage mechanisms;

a first linear actuator coupled to the seat-plate drive tube that controls a position of the seat plates;

an ottoman-linkage drive tube extending between and coupled to both ottoman front pivot links of the mirror-image linkage mechanisms, and a second linear actuator coupled to the ottoman-linkage drive tube.

15. The mechanism of claim 14, wherein the second linear actuator coupled to the ottoman linkage drive tube is controllable independently from the first linear actuator coupled to the seat-plate drive tube.

16. The mechanism of claim 14, wherein the front pivot link includes a first pivot and a second pivot that are spaced a first distance apart and that attach the front pivot link to the seat plate and the side rail, respectively;

wherein the rear pivot link includes a third pivot and a fourth pivot that are spaced a second distance apart and that attach the front pivot link to the seat plate and the side rail, respectively; and wherein a ratio of the first distance to the second distance is about 9.5:6.5.

17. The mechanism of claim 16, wherein the first pivot and the third pivot are spaced a third distance apart;

wherein the second pivot and the fourth pivot are spaced a fourth distance apart; and wherein a ratio of the third distance to the fourth distance is about 10:12.5.

* * * * *